US006508372B1

(12) United States Patent
Lamphen et al.

(10) Patent No.: US 6,508,372 B1
(45) Date of Patent: Jan. 21, 2003

(54) METHOD FOR USING A REVOLVER CRANE, AND A REVOLVER CRANE

(75) Inventors: Nicolaas Lamphen, Vianen (NL); Johannes Antonius Van Seumeren, Utrecht (NL)

(73) Assignee: Mammoet Holding B.V., De Meern (NL)

( * ) Notice: Subject to any disclaimer, the term of this patent is extended or adjusted under 35 U.S.C. 154(b) by 0 days.

(21) Appl. No.: 09/421,925

(22) Filed: Oct. 20, 1999

(30) Foreign Application Priority Data

Oct. 20, 1998 (NL) ..... 1010355

(51) Int. Cl.[7] ..... B66C 23/76
(52) U.S. Cl. ..... 212/279; 212/196
(58) Field of Search ..... 212/178, 196, 212/279, 179, 270, 195, 197, 198

(56) References Cited

U.S. PATENT DOCUMENTS

| | | | | | |
|---|---|---|---|---|---|
| 1,245,186 | A | * | 11/1917 | Brothers | 212/196 |
| 3,767,061 | A | * | 10/1973 | Tax et al. | 212/144 |
| 4,000,784 | A | * | 1/1977 | Morrow et al. | 180/9.48 |
| 4,016,974 | A | * | 4/1977 | Tax | 206/321 |
| 4,047,617 | A | * | 9/1977 | Tax et al. | 212/39 MS |
| 4,557,390 | A | | 12/1985 | Mick | |
| 4,579,234 | A | | 4/1986 | Delago et al. | |
| 5,035,337 | A | * | 7/1991 | Juergens | 212/196 |
| 5,253,771 | A | * | 10/1993 | Mikilas et al. | 212/196 |

FOREIGN PATENT DOCUMENTS

| | | | | |
|---|---|---|---|---|
| DE | 352950 | * | 2/1987 | 212/278 |
| DE | 268458 | * | 5/1989 | 212/196 |
| DE | 25 54 910 | | 6/1997 | |
| EP | 0 354 167 | | 2/1990 | |
| SU | 1463705 | * | 3/1989 | 212/196 |

* cited by examiner

*Primary Examiner*—Thomas J. Brahan
(74) *Attorney, Agent, or Firm*—Rod D. Baker; Jeffrey D. Myers

(57) ABSTRACT

A method for using a revolver crane, comprising the positioning of a ballast on a platform ring in accordance with the repositioning of a load which is supported by a boom, is repositioned in relation to the platform ring as well, so as to cause a balance of moments. A revolver crane for performing this method comprises ballast hoisting elements for hoisting said ballast and repositioning it in relation to the platform ring.

2 Claims, 6 Drawing Sheets

Figure 1:
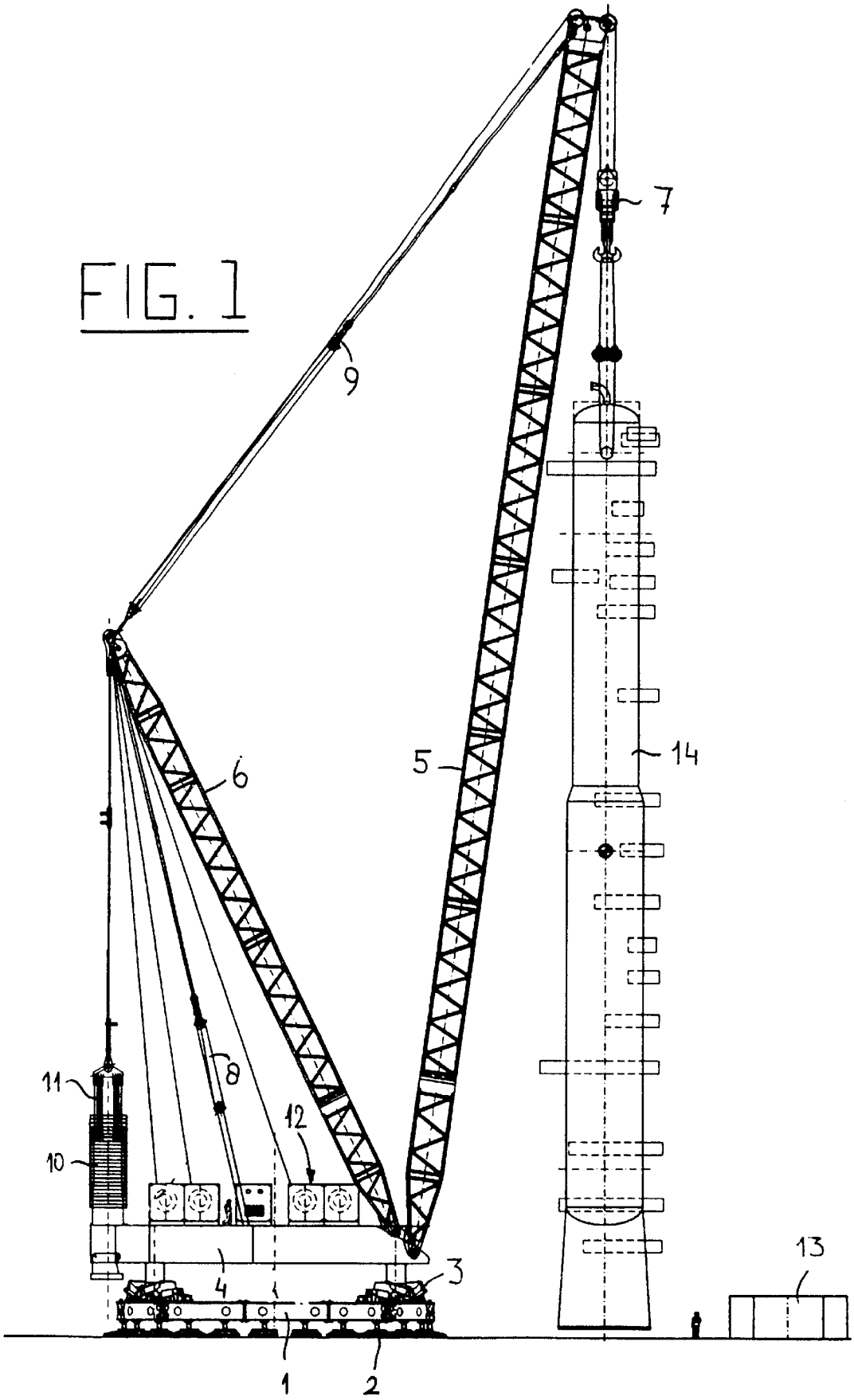

1
2
3
4
5
6
7
8
9
10
11
12
13
14

7
9
14
6
5
8
11
10
1
4
13

7
9
14
5
6
8
11
10
4
1
13

7
9
5
6
8
11
10
4
1
14
13

METHOD FOR USING A REVOLVER CRANE, AND A REVOLVER CRANE

FIELD OF THE INVENTION

Firstly this invention relates to a method for using a revolver crane for repositioning a load, said revolver crane comprising a stationary support ring assembly, a movable platform ring for rotating the crane placed hereon, a boom comprising hoisting elements, being slewable for changing its outreach and which is bearing-mounted on the platform ring, a mast which is also bearing-mounted on the platform ring and further comprising a ballast, which is connected to the mast and which is positioned on the platform ring.

Revolver cranes are commonly used for performing heavy hoisting activities. By means of the support ring assembly the crane is supported by a large ground area, as a consequence of which heavy loads can be hoisted. By transpositioning of the platform ring around the support ring assembly, combined with the variable outreach of the boom, the revolver crane is issued with a large circular working area.

Revolver cranes are among other things used for building, renovation and dismantling of petrochemical and chemical plants as well as for building power stations. In order to be able to absorb the load's moment, which arises from these activities, known revolver cranes will comprise heavy ballast (of the order of 1500 tons). This ballast has a permanent position on the platform ring and serves to yield a counter moment which balances the load moment originating from the load. Because of the heavy ballast the costs of transport of such revolver cranes are excessive.

When transpositioning a load by means of such a revolver crane it is proceeded such that together with the increasing of the load moment (by raising the load and increasing the outreach of the boom) the force which is exerted by the ballast on the mast, and therefor the counter moment also, increases. Since the ballast has a fixed position on the platform ring, the mast of the ballast must be sufficiently large for being able to exert a sufficient counter moment in all cases. This is the reason why such known revolver cranes have an extremely high ballast weight.

The invention aims at a method for using a revolver crane for transporting a load with which a revolver crane can be used in a more effective way.

To this end the method according to the invention is characterized by the subsequent steps of:

a. positioning the support ring assembly in relation to the load to be transported, such that the hoisting elements can be connected to the load, while the boom is in a position of small outreach;

b. raising the load by means of the hoisting elements;

c. slewing the boom so as to increase its outreach, while the ballast is at the same time raised from the platform ring and, by slewing the mast, moving it into a position outside the platform ring such that the moment exerted by the load and the moment exerted by the ballast are in balance;

d. putting down the load on the intended location, after which the hoisting elements are kept connected to the load;

e. transporting the ballast, by slewing the mast, into a position inside in relation to the platform ring and repositioning the ballast on the platform ring;

f. finally disconnecting the hoisting elements from the load and, if necessary, slewing the boom so as to decrease its outreach.

Unlike the known method, wherein the ballast has a fixed position on the platform ring and keeps this fixed position, with the method according to the invention it is such acted as to change the position of the ballast in relation to the platform ring. An important result is that the amount of ballast can be decreased importantly in relation to the known revolver cranes. In fact, in similar hoisting operations, a ballast of about 900 tons can be used instead of a conventional ballast of 1500 tons.

After putting down the load the ballast must be repositioned to its original position on the platform ring. Should the load be disconnected from the hoisting elements immediately after having been put on the intended position, it would no longer be possible to place the ballast back on the platform ring by only using the crane itself. It then would be necessary to transport the ballast in pieces back to the platform ring, which would be very labour intensive. According to the invention the load, after having been put down on the intended position, is being kept connected to the hoisting elements, such that the load produces the counter moment necessary for repositioning the ballast on the platform ring. The more the ballast is repositioned to the inside, the more the counter moment which is exerted by the load (i.e. the force exerted by the hoisting elements) decreases since the load will rest on its support more and more. Finally the ballast reaches its original position on the platform ring after which the connection between the hoisting elements and the load can be ended and, if necessary, the boom can be slewed back to its original position having a small outreach.

Although the main claim relates to a method wherein a load is repositioned outwardly in relation to the revolver crane, it is also possible by reversal of the subsequent steps to reposition a load inwardly in relation to the revolver crane. The essence of the invention, to wit repositioning the ballast outwardly, resp. inwardly, so as to counter balance the moment exerted by a load, remains unchanged.

According to a preferred embodiment of the invention during step c. the ballast is released to a position shortly above the ground and kept in this position. In essence this is a safety measure so as to prevent that in an emergency situation the ballast falls down over too large a distance, for example when, before the load has been put down on the intended location, the connection between the load and the hoisting elements unintentionally is interrupted. If in such a case the ballast is on too high a distance above the ground the crane might fall over.

Of course there is a possibility that during step c. a rotation of the platform ring in relation to the support ring assembly is carried out.

The invention also relates to a revolver crane for performing the method according to the invention, comprising a stationary support ring assembly, a platform ring which is drivable on said assembly for rotating the crane, a boom comprising hoisting elements which is bearing-mounted on the platform ring and which can be slewed for changing its outreach, a mast which is bearing-mounted on the platform ring as well, as well as a ballast which is connected with the mast and which is positioned on the platform ring.

The revolver crane according to the invention is characterized in that the ballast is connected to the mast by means of ballast hoisting elements and which can be raised from the platform ring with said ballast hoisting elements, which mast is slewable for changing its outreach and in that load and moment monitoring means are used for monitoring load and counter momenta exerted by the boom, the load connected to the boom as well as by the ballast, respectively and that control means are used for controlling the outreach of the boom and the mast, respectively, depending on the moments.

With aid of the revolver crane according to the invention of which the ballast does not, contrary to the state of the art, have a fixed position on the platform ring, the method according to the invention can be performed easily. The load and moment monitoring means monitor the load moment which is exerted on the boom and the counter moment which is exerted on the mast and take care for balancing these moments. To this end control means which depend on the load and moment monitoring means are provided.

It is common with the revolver crane of the present type that the mast is connected to the platform ring by means of a pull-in hoist. In such a case it is preferred that the load and moment monitoring means comprise part of the pull-in hoist. In case the load on the pull-in hoist is becoming too high this indicates that the load moment on the boom is too high; otherwise, in case the load on the pull-in hoist is too low it means that the counter moment on the mast is too high. In both cases a compensation has to be given for repositioning the ballast.

Furthermore it is mentioned that the control means may be positioned decentrally with regard to the respective driving mechanisms. By drive mechanisms are meamt among other things those mechanisms that take care of the slewing of the boom and the mast, respectively as well as for activating the ballast hoisting means.

Such a control usually is arranged centrally by a large amount of wires that lead from a central position to the driving means. The decentralized control as presented here has a number of advantages. On the one hand the construction becomes better organized, more reliable as well as less prone to breakdown. Besides these advantages there is less chance of leakage and repair and maintenance can be carried out more easily.

Finally there is a possibility that the revolver crane is constructed from segments which can be transported by standard containers. In this way the revolver crane complies with container specification when transported, which means that use can be made of containers. In this way transport is cheaper and faster. Furthermore less storage room is necessary, less people are needed during transport and use can be made of well organized logistics of container organisations.

The invention will now be described by means of a drawing wherein an embodiment of the revolver crane according to the invention is shown.

FIGS. 1–6 show 6 subsequent steps of a method according to the invention for use of the revolver crane according to the invention.

The revolver crane, as showed in the figure, according to the invention, mainly consists of the following components:

- a stationary support ring assembly 1 comprising legs 2, a platform ring 4, which can be transported across said support ring assembly by means of bogey frames 3, a boom 5, which is bearing-mounted on the platform ring 4, and a mast 6, which is bearing-mounted on the platform ring as well.

The boom 5 is slewable for changing its outreach and comprises hoisting elements 7. Furthermore, hoisting means 8 and 9 are used by which the position of the boom 5 and the mast 6 can be adjusted.

A ballast 10 is installed on the platform ring 4, which is connected to the mast 6 by means of the ballast hoisting elements 11.

On the platform ring 4 there are several drive means 12 for driving among other things the hoisting means 8, 9 as well as the ballast hoisting elements 11, as well as for activating the hoisting elements 7. These hoisting elements are commonly known and will not be discussed here.

Hereafter, the subsequent steps for placing a load 14 (for example a load 14 forming a part of a petrochemical plant) on a foundation 13 are described by means of the FIGS. 1–6, wherein use is made of a revolver crane as described herein before regarding its basic parts.

FIG. 1 shows a boom 5, which has a small outreach. The support ring assembly 1 is positioned on such a distance from the load 14 which has to be repositioned, that at this outreach the hoisting elements 7 can be connected to the load 14. In this situation the ballast 10 is positioned on the support ring assembly 1 and the load 14 has just been raised from the ground.

Figure 2:
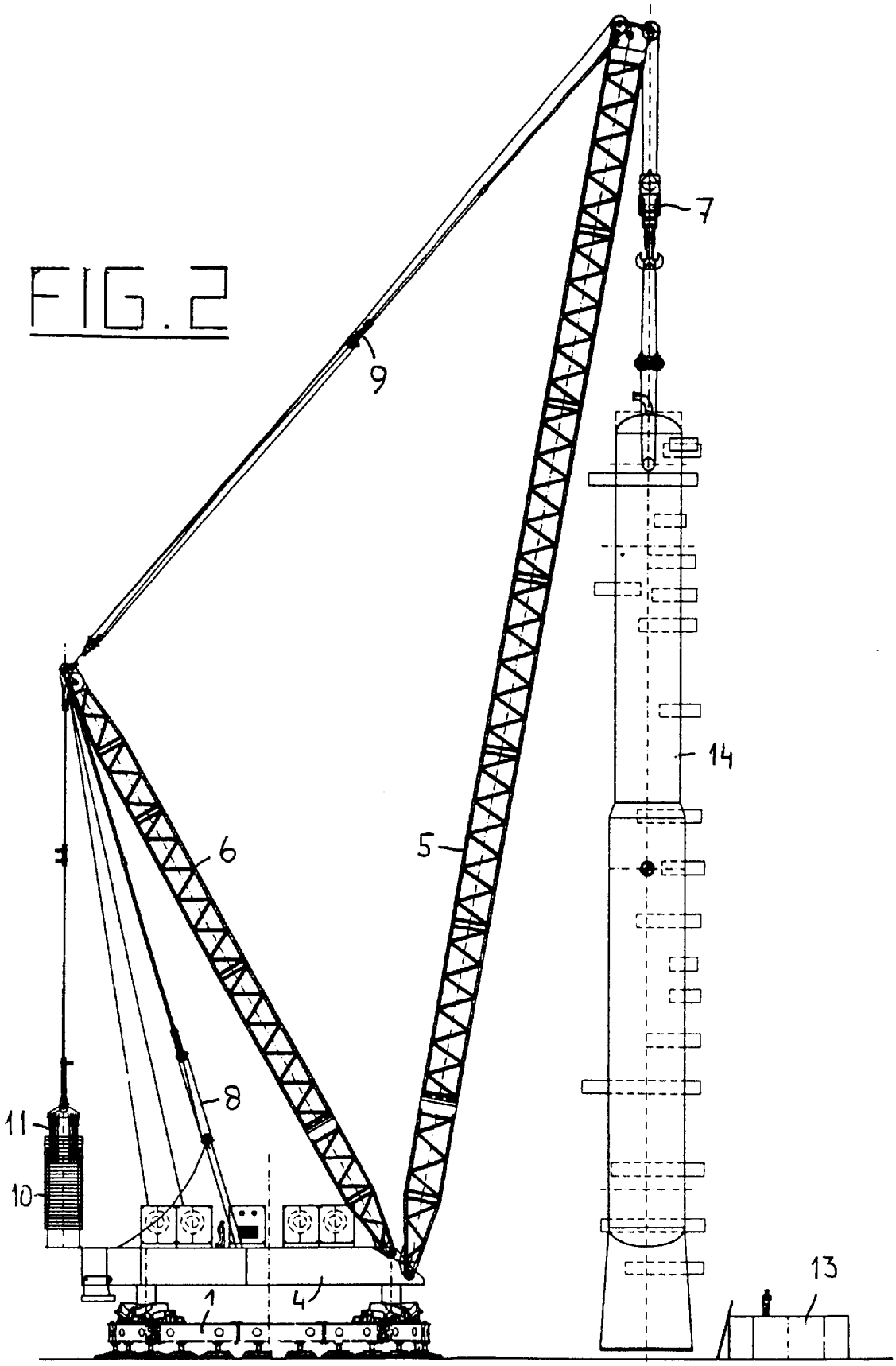

In FIG. 2 the boom 5 has obtained a larger outreach by slewing and the load 14 has been moved to the right. The increase of the moment caused by the load-is balanced by an increase of the counter moment which is caused by the ballast 10. By a convenient control of among other things the hoisting means 8 and 9, the boom 5, as seen in this figure, is moved to the right, which increases its outreach and which causes the load 14 to be moved to the right. The hoisting elements 7 are controlled such that the bottom sight of the load 14 remains at about the same distance above the ground. At the same time mast 6 is slewed to the left as seen in the figure such that the ballast 10 is repositioned outwardly relative to the support ring assembly 1 (or platform ring 4). The increase of the outreach of the boom 5 and the increase of the outreach of the mast 6 are controlled such that at any time a convenient balance of momenta is obtained such that the revolver crane retains a stable position. One way to obtain a stable position is that the hoisting means 8 comprise control means for controlling the load and the moment. When these control means measure too high force in the hoisting means 8 this means that the moment on the boom 5 is too high and that a larger outreach of the mast 6 is needed, on the other hand a too low force in the hoisting means 8 means that the moment caused by the ballast 10 is too high, which means that the outreach of the mast 6 must be decreased.

Figure 3:
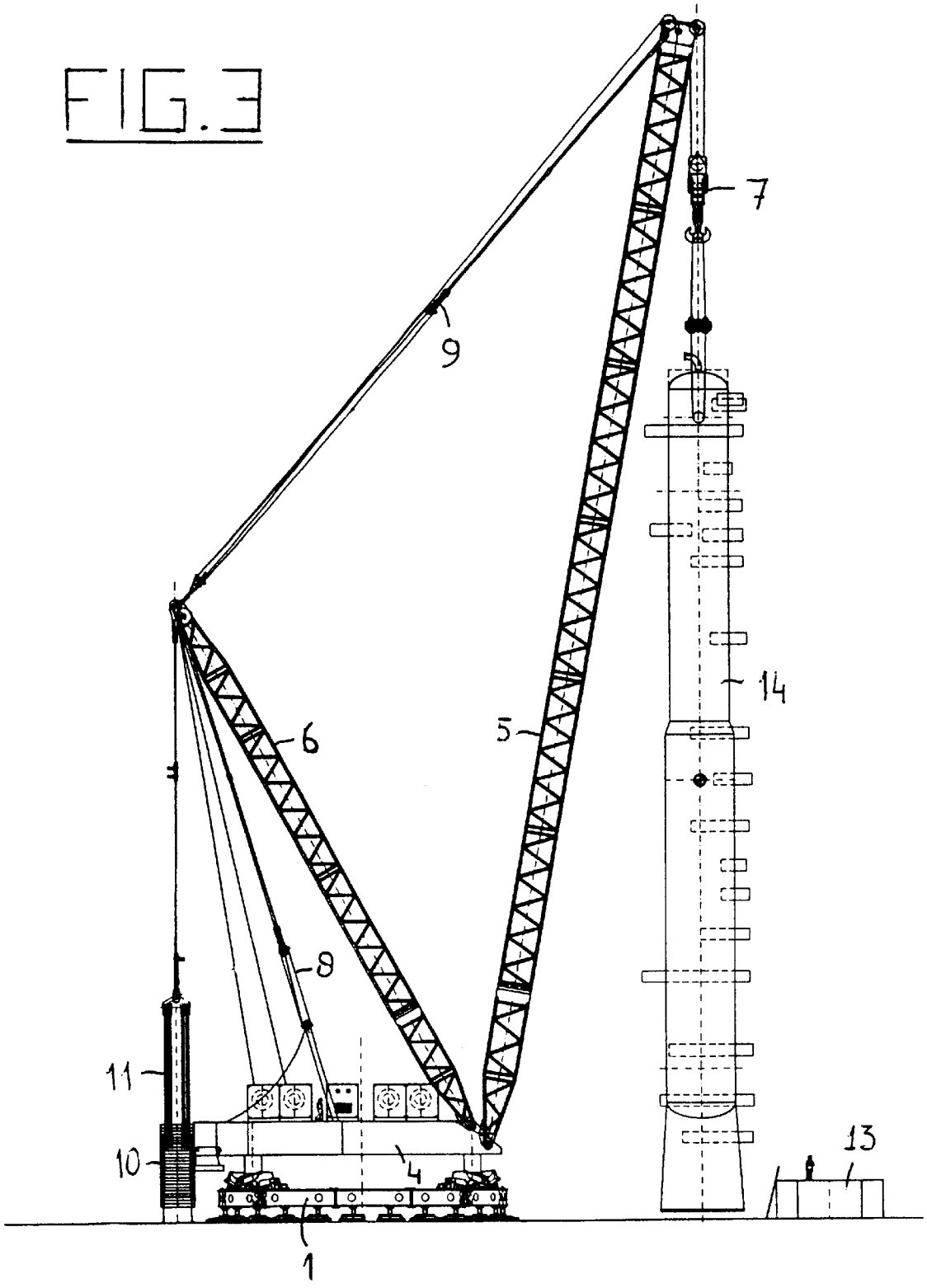

In FIG. 3 it is shown that the outreach of the mast 6 has become such that the ballast 10 is completely outside the platform ring 4. For safety reasons, the ballast 10, by means of ballast hoisting means 11, is released to a position just above the ground. In this way it is assured that, in case of an emergency situation when the load moment decreases very fast and the crane threatens to fall over because of the exerted counter moment, the ballast 10 reaches the ground fast and the turning over of the crane is prevented. During the increase of the outreach of the mast 6 the distance of the ballast 10 to the ground is kept constant by means of a suitable control of the ballast hoisting means 11.

Figure 4:
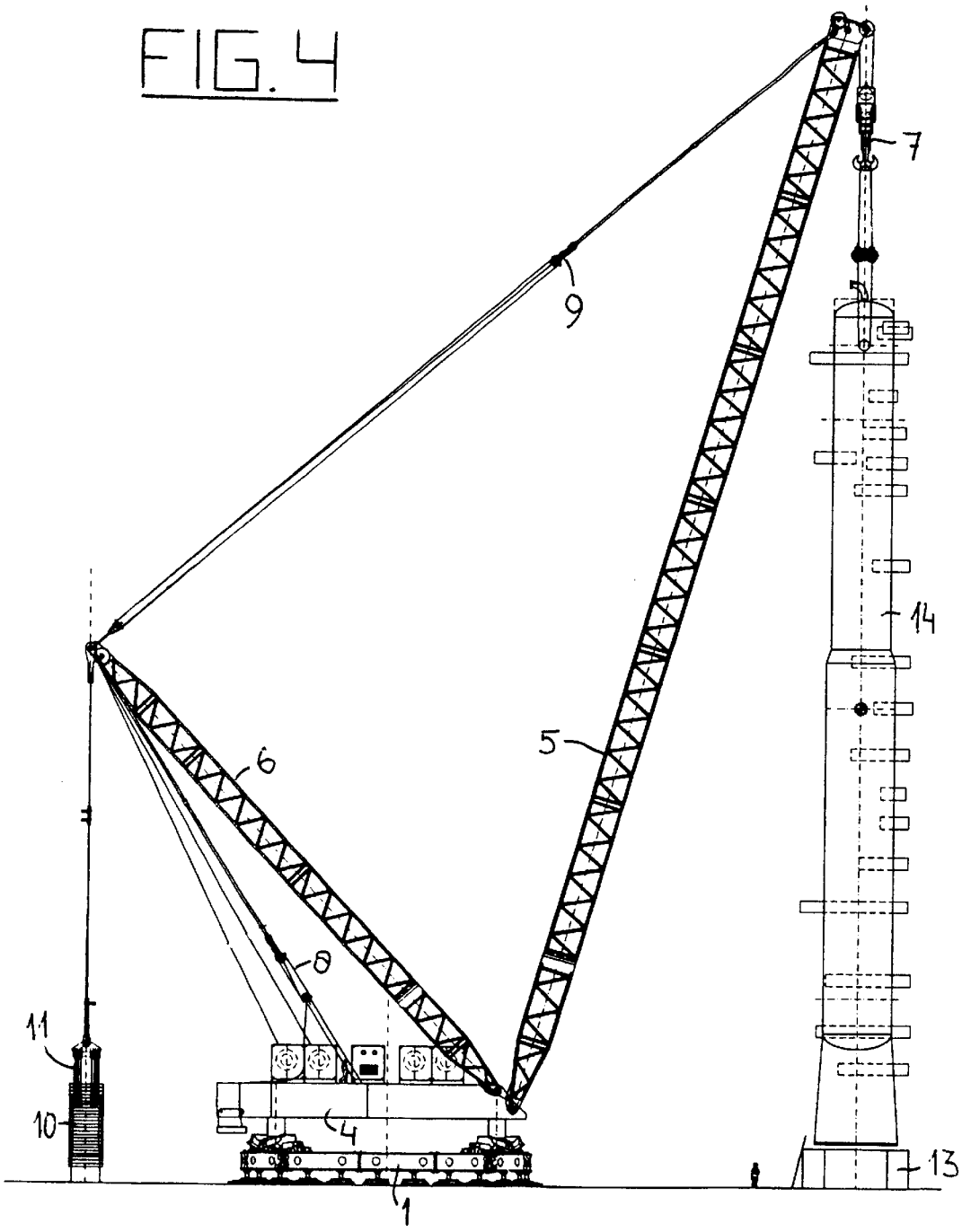

In FIG. 4 it is shown that the load 14 has arrived above its position above the foundation 13. In this situation the boom 5, and the mast 6 as well, have reached their maximum outreach. In this situation the load 14 can be put down on the foundation 13 (FIG. 5), however, the hoisting elements 7 keep connected to the load 14 after having put down the load 14 on the said foundation 13.

Figure 5:
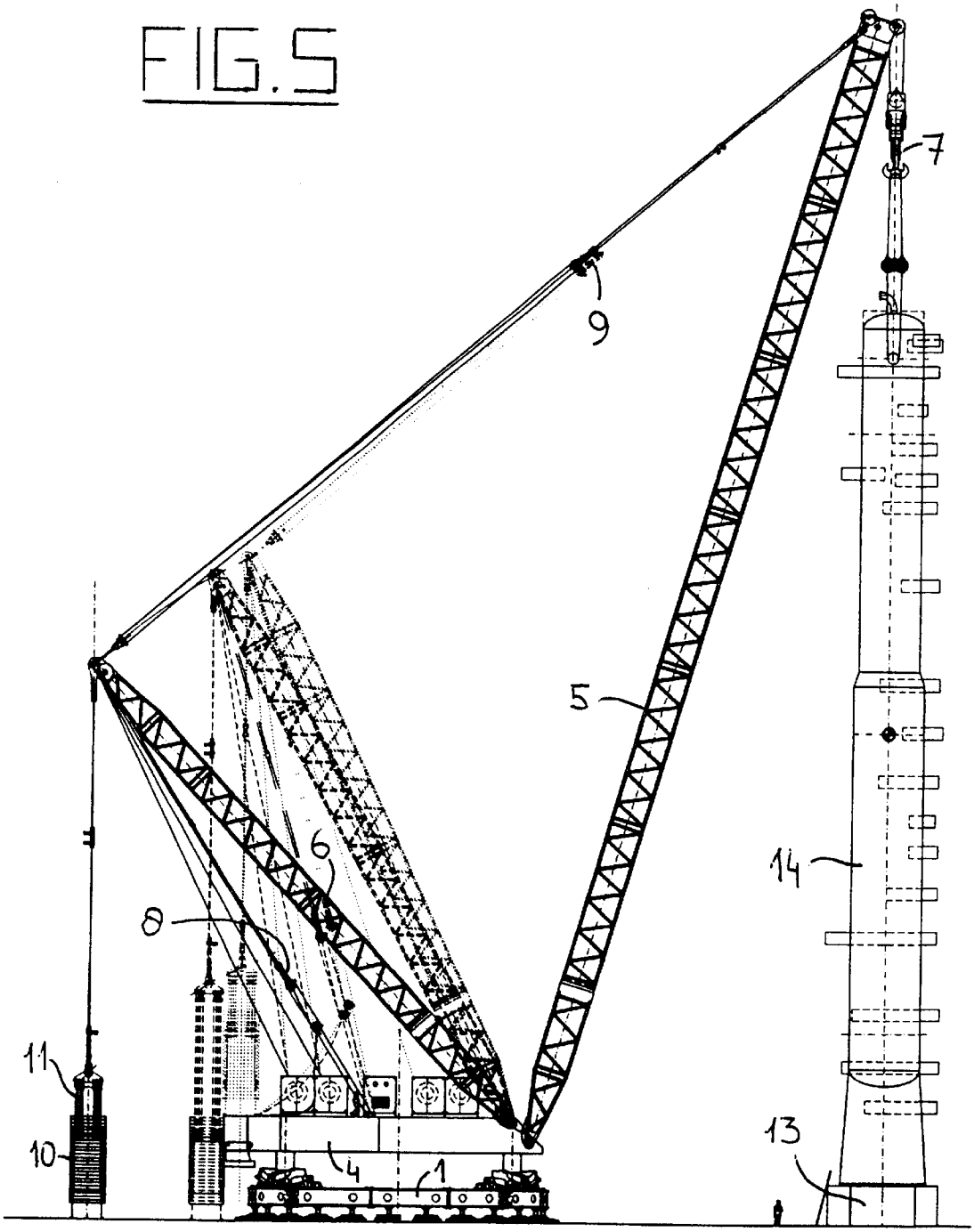

The ballast 10 now has reached a position some distance outside the platform ring 4. Of course it is desirable that the ballast 10 is repositioned to the platform ring 4. To this end, use is made of the load 14. The moment exerted by the load 14 is sufficient to compensate for the counter moment exerted by the ballast 10 to the mast 6. By slewing the mast 6, as seen in FIG. 5, to the right (such that its outreach becomes smaller), the ballast 10 can be repositioned to the platform ring 4 and be put down on it. This has been indicated in FIG. 5 by several dotted lines. The smaller the outreach of the mast 6 and the smaller the counter moment exerted by the ballast 10, the heavier the load 14 rests on the foundation 13.

Figure 6:
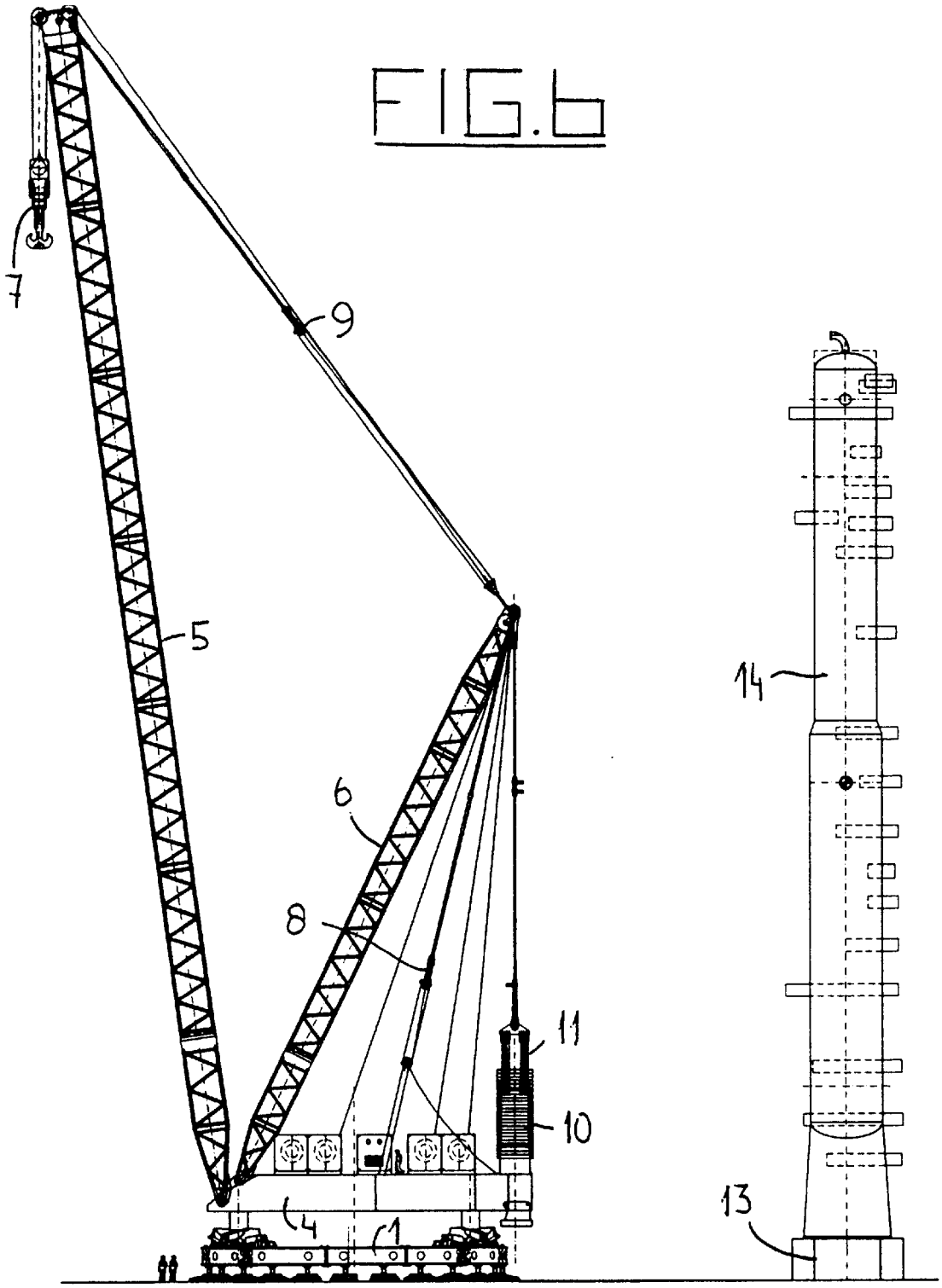

When the ballast 10 at last is positioned on the platform ring 4, the hoisting elements 7 can be disconnected from the load 14 and the boom 5 can be slewed back to its starting position as shown in FIG. 6. By the way, in FIG. 6 a position of the revolver crane is shown, wherein it has been rotated across the support ring assembly 1 over 180°.

Of course it is also possible to perform the method in the other way, which means that the load can be repositioned from the position as shown in FIG. 6 from a greater distance from the revolver crane to the position as shown in FIG. 1 on a shorter distance from the revolver crane. The principle that a counter moment is used for balancing the moment exerted by the load, and which is variable because of the change of the outreach of the mast 6, remains unchanged.

The invention is not restricted to the embodiments shown and described above, but it will be apparent that modifications and variations may be made without departing from the subject matter of the invention, as described in the appending claims.

What is claimed is:

1. A revolver crane comprising:

a stationary support ring assembly, a platform ring which is drivable on said assembly for rotating the crane, a boom comprising hoisting elements which is bearing-mounted on the platform ring and which can be luffed for changing its outreach, a mast, which is bearing-mounted on the platform ring as well, and a ballast connected to the mast by ballast hoisting elements, wherein said ballast can be raised from the platform ring with said ballast hoisting elements, and said mast is luffed for changing its outreach during the changing of the outreach of said boom, and wherein load and moment monitoring means are used for monitoring load and counter momenta exerted by the boom and the load connected to the boom and by the ballast, respectively, and wherein control means are used for controlling the outreach of the boom and the mast depending on the momenta.

2. The revolver crane according to claim 1, wherein the mast is connected to the platform ring by means of a pull-in hoist, wherein the load and moment monitoring means are part of the pull-in hoist.

* * * * *